US012780371B2

(12) United States Patent
Thomson et al.

(10) Patent No.: US 12,780,371 B2
(45) Date of Patent: Nov. 3, 2026

(54) METHODS AND SYSTEMS FOR DETECTING ONE OR MORE ANOMALIES AMONGST PEERS

(71) Applicant: Aktiebolaget SKF, Gothenburg (SE)

(72) Inventors: Allan Alexander Thomson, Guisborough (GB); Yaara Pninit Feldman-Vishnia, Kadima-Zoran (IL); Nofar Ben-Haim, Ramat Yishay (IL)

(73) Assignee: Aktiebolaget SKF, Gothenburg (SE)

( * ) Notice: Subject to any disclaimer, the term of this patent is extended or adjusted under 35 U.S.C. 154(b) by 427 days.

(21) Appl. No.: 18/501,574

(22) Filed: Nov. 3, 2023

(65) Prior Publication Data

US 2025/0145260 A1 May 8, 2025

(51) Int. Cl.

| | |
|---|---|
| ***B63B 79/30*** | (2020.01) |
| ***B63B 79/10*** | (2020.01) |
| ***E02B 17/02*** | (2006.01) |
| ***E02B 17/08*** | (2006.01) |

(52) U.S. Cl.

CPC ..... *B63B 79/30* (2020.01); *B63B 79/10* (2020.01); *E02B 17/021* (2013.01); *E02B 17/08* (2013.01)

(58) Field of Classification Search

CPC ..... B63B 79/30; B63B 79/10; B63B 79/00; E02B 17/021; E02B 17/02; E02B 17/00; E02B 17/08; E02B 17/04; G05B 23/0237; G05B 23/024; G05B 23/0224; G05B 23/0218; G05B 23/0205; G05B 23/02; G05B 23/00

See application file for complete search history.

(56) References Cited

U.S. PATENT DOCUMENTS

| | | | | |
|---|---|---|---|---|
| 2009/0030752 | A1* | 1/2009 | Senturk-Doganaksoy | G06Q 50/06 705/7.41 |
| 2013/0261988 | A1 | 10/2013 | Lim et al. | |
| 2019/0226407 | A1* | 7/2019 | Karpman | G05B 13/041 |
| 2020/0149998 | A1 | 5/2020 | Ayyagari et al. | |
| 2020/0386841 | A1* | 12/2020 | Iben | G11B 5/455 |

(Continued)

OTHER PUBLICATIONS

International Search Report and Written Opinion of the ISA/EP in PCT/EP2024/078522, dated Jan. 13, 2025; 12pgs.

*Primary Examiner* — Mohamed Charioui
(74) *Attorney, Agent, or Firm* — Stinson LLP

(57) ABSTRACT

A rotational equipment peer anomaly system includes rotational equipment condition sensors, a rotational equipment peer anomaly processor, and a non-transitory tangible storage medium. The sensors are configured to detect rotational equipment conditions associated with the peer devices and generate rotational equipment condition sensor data corresponding to the conditions. The non-transitory tangible storage medium stores rotational equipment peer anomaly processor executable instructions that, when executed, causes the processor to receive the sensor data, determine a data scope parameter, apply the data scope parameter to the sensor data, analyze the sensor data to determine rotational equipment condition data features associated with the peer devices, compare each data feature with each of the other data features to determine rotational equipment condition data feature values associated with the peer devices, and analyze the data feature values to identify at least a first rotational equipment condition data feature value satisfying an anomaly threshold.

12 Claims, 9 Drawing Sheets

(56) References Cited

U.S. PATENT DOCUMENTS

| | | | | |
|---|---|---|---|---|
| 2022/0187164 | A1 | 6/2022 | Azamfar et al. | |
| 2023/0325292 | A1* | 10/2023 | Ardel | G06F 11/3058 |
| 2024/0085278 | A1* | 3/2024 | Taguchi | G01M 99/005 |
| 2025/0131832 | A1* | 4/2025 | Adhikari | G08G 5/30 |

* cited by examiner

METHODS AND SYSTEMS FOR DETECTING ONE OR MORE ANOMALIES AMONGST PEERS

FIELD

Aspects of the present disclosure relate to data processing and, more particularly, to detecting one or more anomalies amongst a plurality of peer devices.

BACKGROUND

Jack-up vessels may be used for a range of offshore activities, including exploration, drilling, well maintenance, platform installation, and construction work. Known jack-up vessels include a plurality of gearboxes serving various functions. To ensure proper functioning, safety, and reliability of a jack-up vessel, its gearboxes may be monitored to see if any require servicing and/or maintenance. However, known methods and systems for monitoring a plurality of peer devices, such as the gearboxes of a jack-up vessel, can be cumbersome, costly, and/or time consuming.

At least some known monitoring methods and systems may identify a potential issue when current sensor data is inconsistent with historical sensor data. However, sensor data can vary considerably among different contexts. For example, because jack-up vessels are often moved between offshore locations, sensor data for one operation at one time of day in one location (e.g., raising the jack-up vessel during low tide in the Gulf of Mexico) is likely to be different from sensor data for another operation at another time of day in another location (e.g., lowering the jack-up vessel during high tide in the North Sea). At least some known monitoring methods and systems are incapable of accounting for variability due to different contexts and/or identifying a root cause for an inconsistency in real-time or near-real-time, particularly where there is a large volume of sensor data for dynamic attributes or criteria.

SUMMARY

The present disclosure enables organizations to monitor a plurality of peer devices by detecting one or more anomalies amongst the peer devices. In one aspect, a rotational equipment peer anomaly system is provided for a plurality of rotational equipment peer devices. The rotational equipment peer anomaly system includes a plurality of rotational equipment condition sensors configured to detect one or more rotational equipment conditions associated with the rotational equipment peer devices and generate rotational equipment condition sensor data corresponding to the rotational equipment conditions. The system further includes a rotational equipment peer anomaly processor and a non-transitory tangible storage medium storing rotational equipment peer anomaly processor executable instructions that, when executed by the rotational equipment peer anomaly processor, causes the rotational equipment peer anomaly processor to receive the rotational equipment condition sensor data, determine at least one data scope parameter, apply the data scope parameter to the rotational equipment condition sensor data, analyze the rotational equipment condition sensor data to determine a plurality of rotational equipment condition data features associated with the rotational equipment peer devices, compare each rotational equipment condition data feature with each of the other rotational equipment condition data features to determine a plurality of rotational equipment condition data feature values associated with the rotational equipment peer devices, and analyze the rotational equipment condition data feature values to identify, from the rotational equipment condition data feature values, at least a first rotational equipment condition data feature value satisfying an anomaly threshold, wherein the first rotational equipment condition data feature value corresponds to a first rotational equipment peer device of the rotational equipment peer devices.

Other aspects and features of the present disclosure will be in part apparent and in part pointed out herein. This Summary is provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

BRIEF DESCRIPTION OF THE DRAWINGS

Aspects of the present disclosure are described in detail below with reference to the attached drawing figures, wherein.

Corresponding reference numbers indicate corresponding parts throughout the drawings.

DETAILED DESCRIPTION

Figure 1:
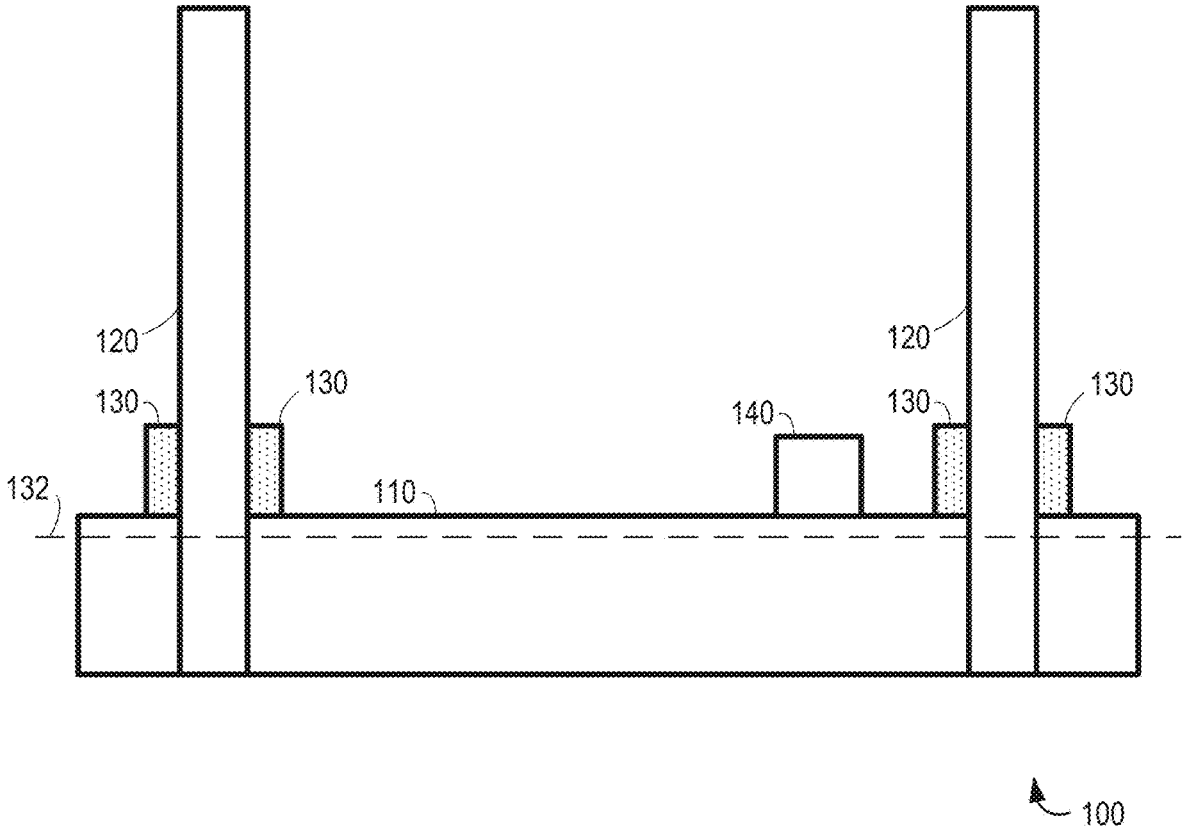
FIG. 1 is a block diagram illustrating an example jack-up vessel in a first state.

According to various examples of the present disclosure, one or more anomalies are detected amongst a plurality of peer devices to facilitate predicting maintenance needs and/or preventing unexpected failures. The systems and methods described herein analyze datasets to detect anomalies in the context of jack-up vessels, which may include scores of gearboxes, all running at the same speed (or substantially similar speeds) to share the load and keep things even while raising and/or lowering the jack-up vessel. However, the systems and methods described herein are not limited to this particular application and may be used in other contexts in which one or more peer devices are monitored such as cooling tower fan gearboxes, wind turbines, tidal turbines, paper mill rollers, and other multiple asset arrangements where conditions continuously change over time but at any moment in time the assets are performing under similar conditions. Examples described herein improve the statistical values representing the norm by eliminating outliers, whether they are due to being anomalies, bad data, etc., in real-time or near-real-time. In this manner, the systems and methods described herein enable potential trouble spots to be quickly identified in a reliable, unbiased manner. Where the statistical values are not acquired synchronously, timestamps may be used to build a matrix of statistical values associated with similar dates/times.

Aspects of the present disclosure provide for a computing system that performs one or more operations in an environment including a plurality of devices coupled to each other via a network (e.g., a local area network (LAN), a wide area network (WAN), the internet). The systems and methods described herein may be implemented using computer programming or engineering techniques including computer software, firmware, hardware, or a combination or subset thereof.

Unless defined otherwise, all technical and scientific terms used herein have the same meaning as commonly understood by one of ordinary skill in the art to which the present disclosure belongs. Although any methods and materials similar to or equivalent to those described herein can be used in the practice or testing of the present disclosure, some preferred methods and materials are described below.

As used herein, the term "peer devices" refers to a set or collection of devices, apparatuses, and/or systems which have similar capabilities and functions as each other and share one or more similar kinds of tasks, services, and/or resources in one or more similar environments. It will be appreciated that peer devices may include various types of rotational equipment used in industrial, commercial, and other applications including manufacturing, construction, vehicles, offshore (e.g., jack-up vessel), etc.

As used herein, the term "rotational equipment" refers to a device, apparatus, and/or system that includes one or more rotational components such as gears, sprockets, bearings, or other rotating elements. For example, rotational equipment can include conveyors, chain drives, belt drives, gear drives, bearing arrangements, etc. Rotational components are subject to wear, require maintenance and/or replacement, and can serve critical functions in operation or performance of rotational equipment. Considering the importance of rotational components in rotational equipment, an object of the present disclosure is to monitor performance of such rotational components (broadly, "rotational equipment peer devices") in a novel peer comparison approach to provide improved detection and remediation capabilities. Rotational equipment peer devices can be the rotational components themselves and/or assemblies including such rotational components, such as conveyors, chain drives, belt drives, gear drives, bearing arrangements, etc.

According to the present disclosure, rotational equipment condition sensors may be deployed with respect to the equipment peer devices, such as directly to rotational components, to assemblies including the rotational components, or to structure connected to or associated with the rotational components, in a way that permits the rotational equipment condition sensors to detect one or more rotational equipment conditions associated with the rotational equipment peer devices and generate rotational equipment condition sensor data corresponding to the rotational equipment conditions.

Some known methods and systems determine outliers and/or anomalies from a set a values using clustering models. However, one model which may work well on one dataset is not likely to work well on another dataset having a different distribution pattern. Moreover, some known methods and systems may detect outliers and/or anomalies using a trend/timeline analysis. However, either the amount of data or the trend noise due to operating factors often render the detection ineffective.

The systems and methods disclosed herein provide a technological solution to such technical problems by determining a norm from "inlier" peer devices and then detecting one or more "outlier" peer devices. The technical effect of the systems and methods described herein is achieved by using a computing system configured to perform one or more of the following operations: (i) receiving rotational equipment condition sensor data; (ii) determining whether a quantity of rotational equipment condition sensor data satisfies a data threshold; (iii) determining at least one data scope parameter; (iv) applying at least one data scope parameter to rotational equipment condition sensor data; (v) identifying one or more configurations; (vi) analyzing rotational equipment condition sensor data to determine a plurality of rotational equipment condition data features associated with a plurality of rotational equipment peer devices; (vii) comparing each rotational equipment condition data feature with each of the other rotational equipment condition data features to determine a plurality of rotational equipment condition data feature values associated with a plurality of rotational equipment peer devices; (viii) analyzing rotational equipment condition data feature values to identify at least a first rotational equipment condition data feature value satisfying an anomaly threshold; (ix) identifying a period of time or event; (x) comparing rotational equipment condition data features corresponding to a period of time or event; (xi) determining one or more inlying feature values and one or more outlying feature values; (xii) comparing one or more outlying feature values to an anomaly threshold to identify at least a first rotational equipment condition data feature value satisfying the anomaly threshold; (xiii) analyzing rotational equipment condition data feature values to identify one or more rotational equipment condition data feature values corresponding to one or more candidate anomalies; (xiv) comparing rotational equipment condition data feature values to an anomaly threshold to identify at least a first rotational equipment condition data feature value satisfying the anomaly threshold; (xv) generating a list including at least a first rotational equipment condition data feature value satisfying an anomaly threshold; (xvi) using at least a first rotational equipment condition data feature value to determine a new anomaly threshold; (xvii) automatically operating one or more actuators to inspect at least a first rotational equipment peer device; (xviii) automatically operating one or more actuators to modify the first rotational equipment peer device. Performing such multivariate analysis in the human mind would be impractical, if not impossible, at least due to the exceedingly large and/or apparently infinite amounts of data considered and the time sensitivity due to changing circumstances.

Figure 2:
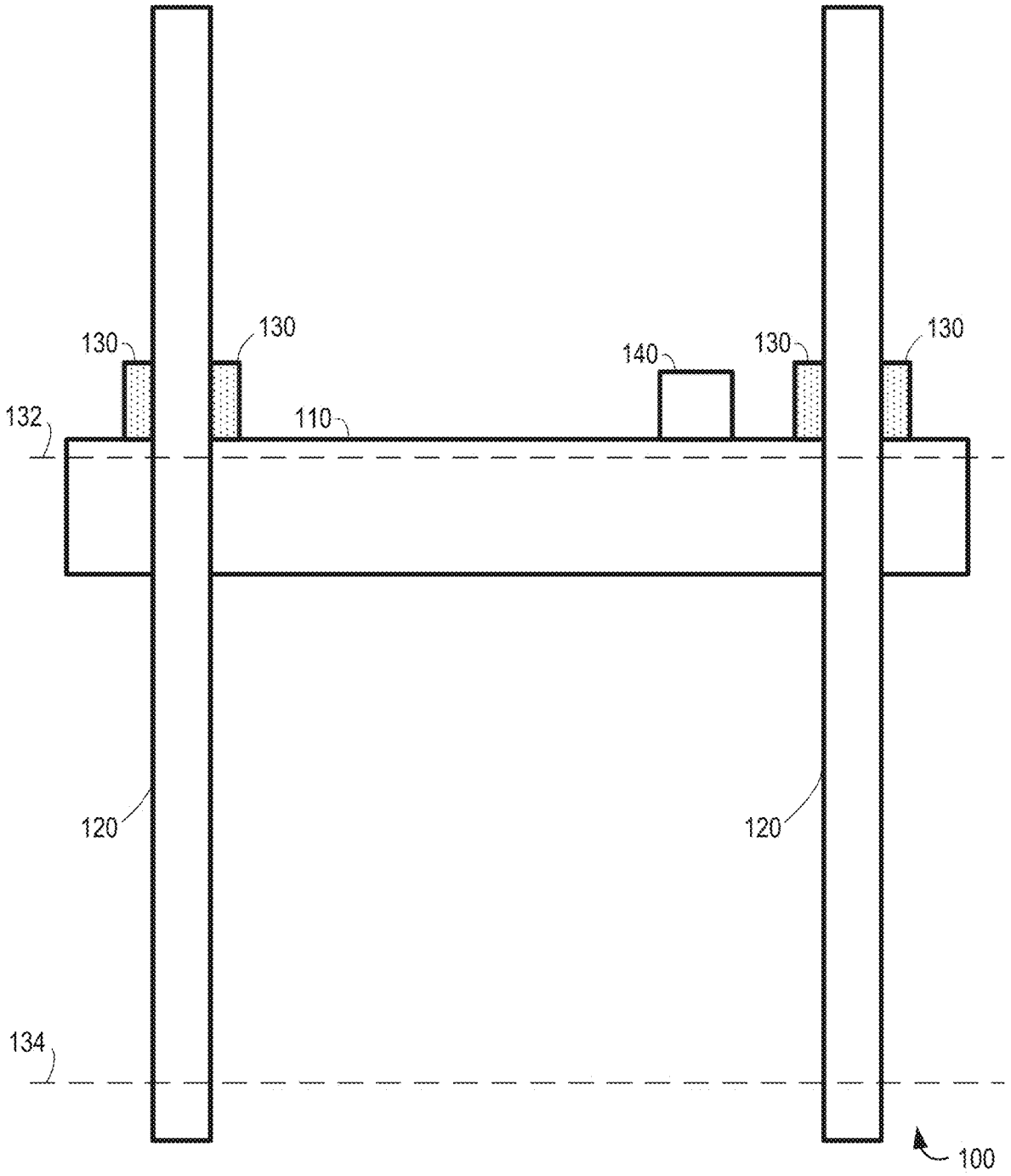
FIG. 2 is a block diagram illustrating the jack-up vessel of FIG. 1 in a second state.
Figure 3:
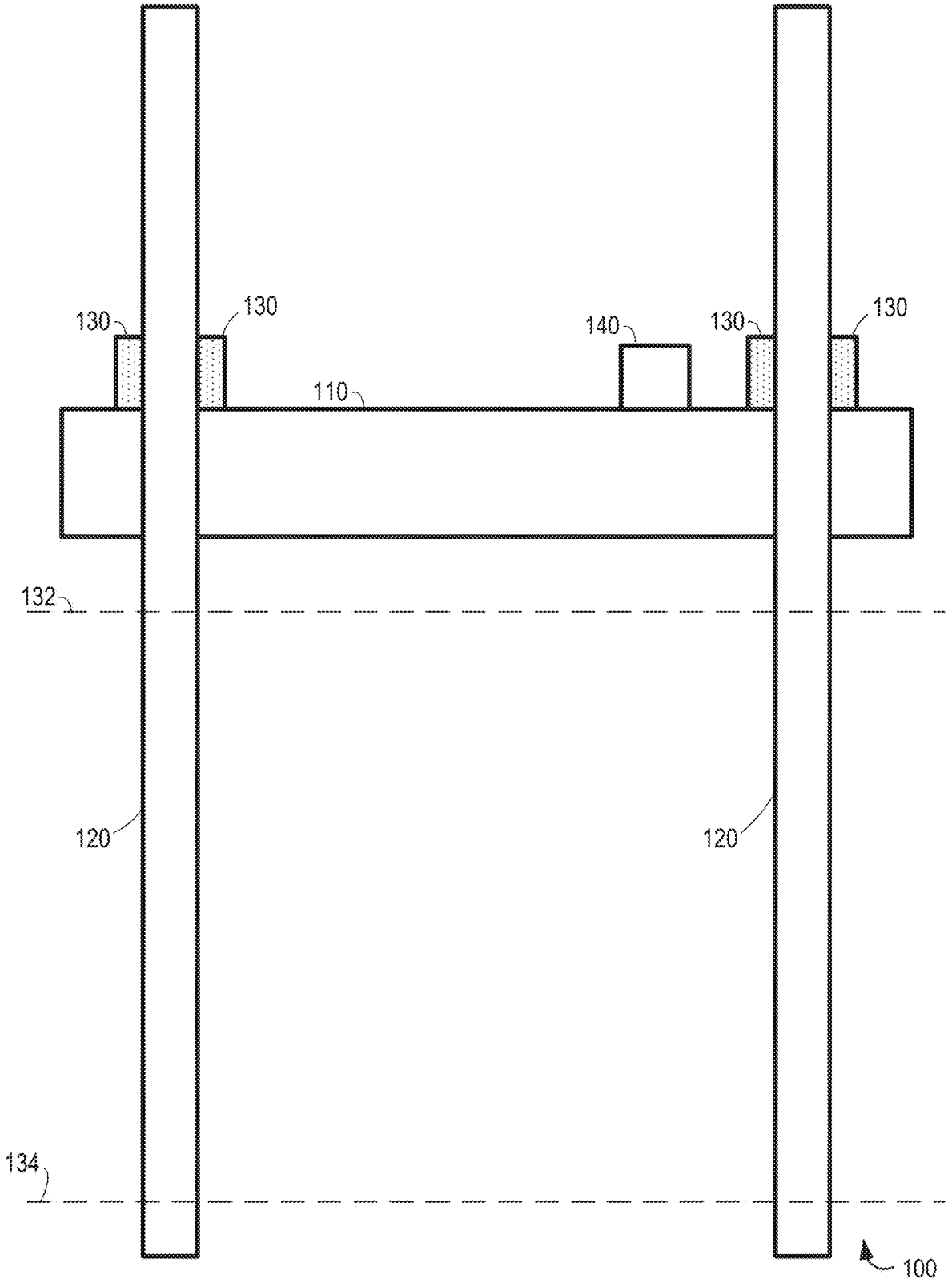
FIG. 3 is a block diagram illustrating the jack-up vessel of FIG. 1 in a third state.

FIGS. 1-3 show an example jack-up vessel 100 including a body 110, a plurality of legs 120 coupled to the body 110, and a plurality of gearboxes 130. Specifically, FIGS. 1-3 show the jack-up vessel 100 in a floating state, a docked state, and an elevated state, respectively.

As shown in FIG. 1, when the jack-up vessel 100 is in the floating state, the legs 120 are retracted such that the body 110 is configured to float on a body of water at or proximate to a water level 132. As shown in FIG. 2, when the jack-up vessel 100 in the docked state, the legs 120 are extended such that a lower end of the legs 120 are in contact with and/or inserted into a floor (e.g., seabed) at a ground level 134. As shown in FIG. 3, when the jack-up vessel 100 is in the elevated state, the legs 120 are further extended such that the body 110 is raised or spaced from the body of water, above the water level 132.

To move the jack-up vessel 100 from the floating state to the docked state, the gearboxes 130 may be used to extend or move the legs 120 towards the ground level 134. To move the jack-up vessel 100 from the docked state to the elevated state, the gearboxes 130 may be used to extend or move the legs 120 such that the body 110 moves up from the water level 132. Conversely, to move the jack-up vessel 100 from the elevated state to the docked state, the gearboxes 130 may be used to retract or move the legs 120 such that the body 110 moves down toward the water level 132. To move the jack-up vessel 100 from the docked state to the floating state, the gearboxes 130 may be used to retract or move the legs 120 away from the ground level 134.

As shown in FIGS. 1-3, a monitoring system 140 may be included in and/or coupled to the jack-up vessel 100 to monitor one or more parameters of the jack-up vessel 100, body 110, legs 120, and/or gearboxes 130. For example, the monitoring system 140 may be configured to monitor a vibration condition of each of the gearboxes 130, such as vibration amplitude and frequency, in real-time or near-real-time. Alternatively, the monitoring system 140 may be configured to monitor load, torque, temperature, noise, depth, alignment, angle, and/or any operating parameter that enables the monitoring system 140 to function as described herein.

The gearboxes 130 shown in FIGS. 1-3 are jacking gearboxes configured to extend, retract, or otherwise move the legs 120 for use in moving the jack-up vessel 100 between the floating state, docked state, and/or elevated state. Alternatively, the gearboxes 130 may be or include a propulsion gearbox, a power generation gearbox, a rotary table gearbox, a crane gearbox, a winch gearbox, and/or any other device, apparatus, and/or system that may be monitored using the monitoring system 140. Moreover, while some examples are illustrated and described herein with reference to the monitored assets (e.g., gearboxes 130) being coupled to or included in a jack-up vessel 100, aspects of the present disclosure may be used to monitor a set or collection of peer devices in any apparatus, system, and/or environment that allows the monitoring system 140 to function or operate as described herein.

Figure 4:
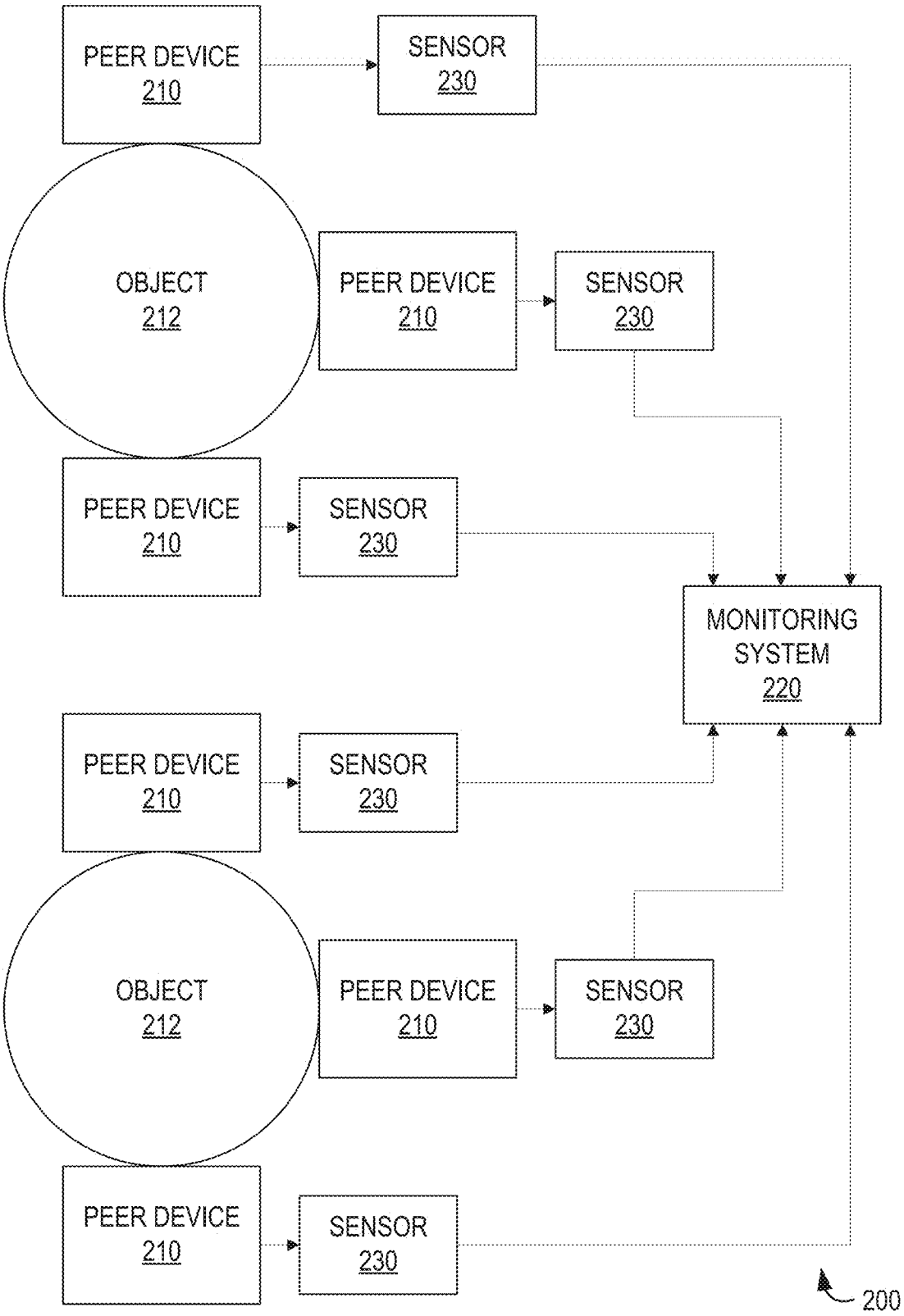
FIG. 4 is a block diagram illustrating an example environment, such as the jack-up vessel of FIGS. 1-3, in which a plurality of peer devices may be monitored.

FIG. 4 shows an example environment 200 in which a plurality of peer devices 210 may be monitored for use in detecting one or more anomalies amongst the peer devices 210. In some examples, the environment 200 may be and/or include the jack-up vessel 100 shown in FIGS. 1-3. For example, the peer devices 210 shown in FIG. 4 may be gearboxes 130 used to move or actuate one or more objects 212 (e.g., legs 120). Alternatively, the peer devices 210 may be any other set or collection of devices, apparatuses, and/or systems which have similar capabilities and functions as each other and share one or more similar kinds of tasks, services, and/or resources in one or more similar environments.

As shown in FIG. 4, the environment 200 may include a monitoring system 220 (e.g., monitoring system 140) including and/or coupled to a plurality of sensors 230 configured to measure or detect one or more conditions (or changes in the conditions) and generate corresponding sensor data. In some examples, the sensors 230 may be and/or include an accelerometer, a gyroscope, an eddy current sensor, a laser sensor, a strain gauge, and/or a microphone configured to detect a vibration condition of the peer devices 210. While some vibration may be expected during normal operation, at least some deviation in the vibration patterns may be indicative of an imbalance, misalignment, looseness, premature or excessive wear, and/or other issue requiring service and/or maintenance. Alternatively, the sensors 230 may be and/or include a type of sensor or detector that enables the monitoring system 220 to function as described herein.

The monitoring system 220 may receive and/or collect the sensor data generated by the sensors 230 to facilitate monitoring and/or controlling one or more industrial processes. In some examples, the monitoring system 220 may analyze the sensor data and automatically operate and/or reconfigure one or more peer devices 210 and/or sensors 230 based on the sensor data. In some examples, the peer devices 210 and/or sensors 230 may be operated and/or reconfigured to perform one or more automated functions including, without limitation, moving one or more objects 212, dispensing lubricant, providing control panel/dashboard warnings, providing integrated operations graphical user interfaces (GUIs), providing maintenance/inspection systems, and the like.

Figure 5:
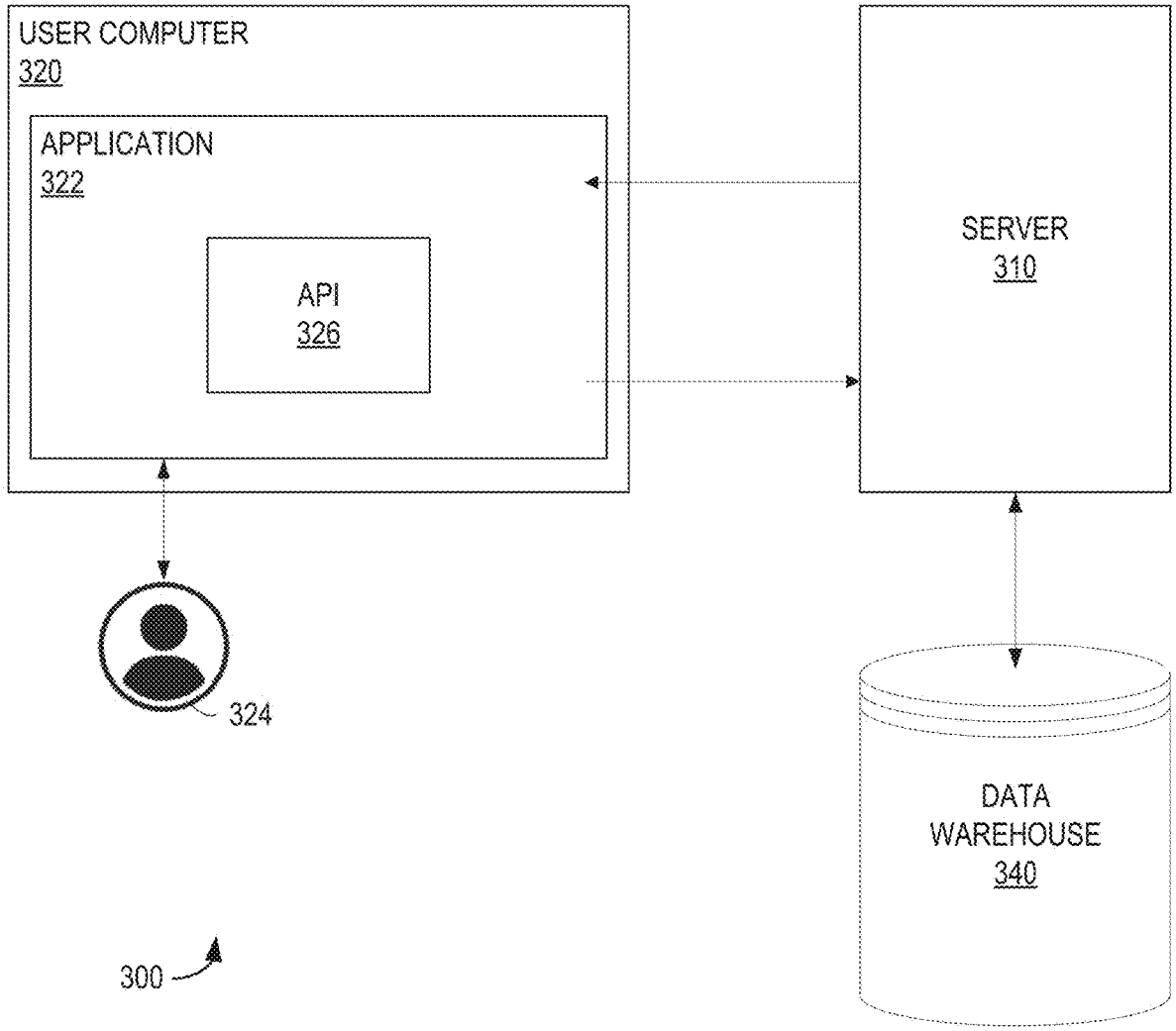
FIG. 5 is a block diagram illustrating an example control system that may be used to monitor and/or control one or more peer devices in an environment, such as the environment of FIG. 2.

FIG. 5 shows an example control system 300 that may be used to monitor and/or control one or more devices (e.g., gearboxes 130, peer devices 210). The control system 300 may include one or more servers 310 and one or more user computers 320 (e.g., monitoring system 140, monitoring system 220) coupled to the servers 310. In some examples, the control system 300 is a distributed computing environment in which the servers 310 and user computers 320 may operate on, in communication with, or as part of a network. For example, a functionality of the server 310 may be provided by the user computers 320 which perform one or more operations as part of, or in communication with, the network. In some examples, the server 310 may host one or more services, applications, portals, and/or other resources for performing one or more operations and/or providing other functionality described herein.

As shown in FIG. 5, the control system 300 may include one or more applications 322 configured to perform a plurality of operations. For example, a user 324 may use the applications 322 to monitor and/or control one or more industrial processes affecting the jack-up vessel 100 (shown in FIGS. 1-3) and/or the environment 200 (shown in FIG. 4). In some examples, the application 322 includes and/or uses an application programming interface (API) 326 configured to communicate one or more other software systems, applications, or software components to facilitate detecting one or more anomalies amongst a plurality of gearboxes 130 (shown in FIGS. 1-3) and/or peer devices 210 (shown in FIG. 4). While one application 322 is shown in FIG. 5 as running on the user computer 320, one of ordinary skill in the art would understand that any number of applications 322 may operate or run on any combination of computing devices that enables the control system 300 to function as described herein.

As shown in FIG. 5, the server 310 and/or user computer 320 may be coupled to a data warehouse 340 configured to store data associated with the server 310, user computer 320, application 322, user 324, and/or API 326. For example, the application 322 and/or API 326 may accumulate time-stamped data and events in the data warehouse 340. In some examples, a functionality of the data warehouse 340 is provided by the server 310 and/or user computer 320 which perform one or more operations as part of, or in communication with, the network. For example, the data warehouse 340 may host or store data structures and/or algorithms used by the application 322 and/or API 326. In some examples, data warehouse 340 may host or store configuration data that enables the server 310 and/or user computer 320 to monitor, operate, reconfigure, and/or detect one or more anomalies amongst a plurality of gearboxes 130 (shown in FIGS. 1-3) and/or peer devices 210 (shown in FIG. 4). Additionally, or alternatively, the data warehouse 340 may host or store any other type of data that enables the control system 300 to function as described herein.

Figure 6:
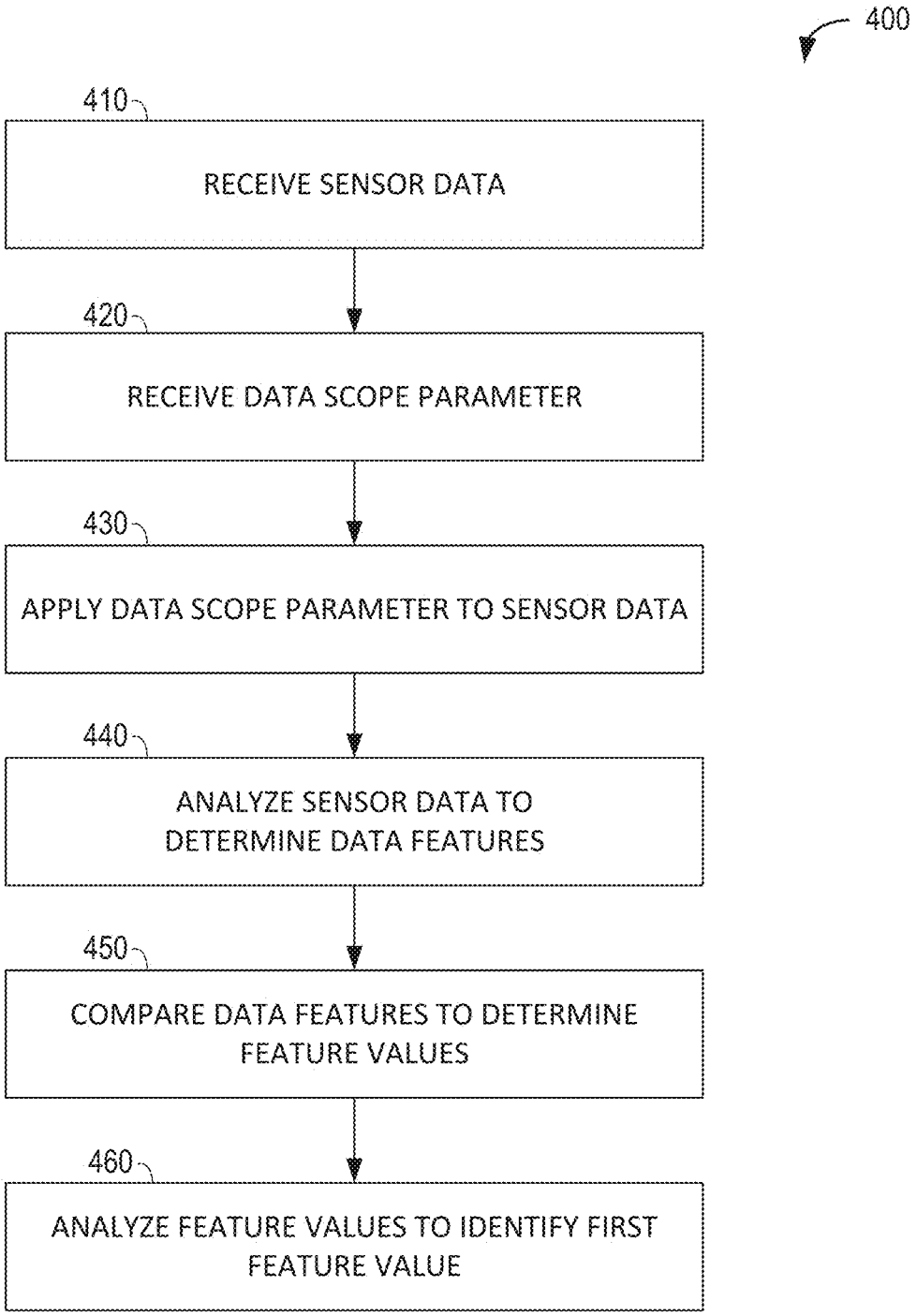
FIG. 6 is a flowchart illustrating an example method for detecting one or more anomalies amongst a plurality of peer devices in the environment of FIG. 4 and/or using the control system of FIG. 5.

FIG. 6 shows an example method 400 for detecting one or more anomalies amongst a plurality of peer devices (e.g., gearboxes 130, peer devices 210). The method 400 may be implemented, for example, by a user computer (e.g., user computer 320) and/or by a server (e.g., server 310) in a client/server system in which the server performs one or more operations for the user computer.

The method 400 includes receiving data associated with the peer devices (e.g., rotational equipment condition sensor data) at operation 410 and receiving at least one data scope parameter at operation 420. The data scope parameters may then be applied to the data at operation 430. Data scope parameters may include one or more processing parameters that define a scope of the data, such as data features and/or data points to include, clusters and/or zones to include, process gates and/or events to include, and the like.

The data may then be analyzed at operation 440 to determine a plurality of data features associated with the peer devices (e.g., rotational equipment condition data features). For example, in the context of analyzing gearboxes 130 (shown in FIG. 1) and/or monitoring their performance, the data features may be determined to facilitate understanding a condition or health of the gearboxes 130. Example data features include, without limitation, vibration amplitude, vibration frequency, load, torque, operating temperature, sound level, noise characteristic, rotational speed, shock load or impact, oil level, oil pressure, oil viscosity, contamination level, presence of wear particles, filter condition, start/stop cycle, operating hours, operating condition, and the like. In some examples, at least one data feature may be selected, created, and/or transformed to facilitate improving the method 400. For example, in some examples, waveform- and/or spectral-derived data features may be extracted and appended to the plurality of data features.

Each data feature may be compared with each of the other data features at operation 450 to determine a plurality of feature values associated with the peer devices (e.g., rotational equipment condition data feature values). The feature values may be analyzed at operation 460 to identify, from the feature values, at least a first feature value which corresponds to a first peer device that satisfies or exceeds an anomaly threshold.

Figure 7:
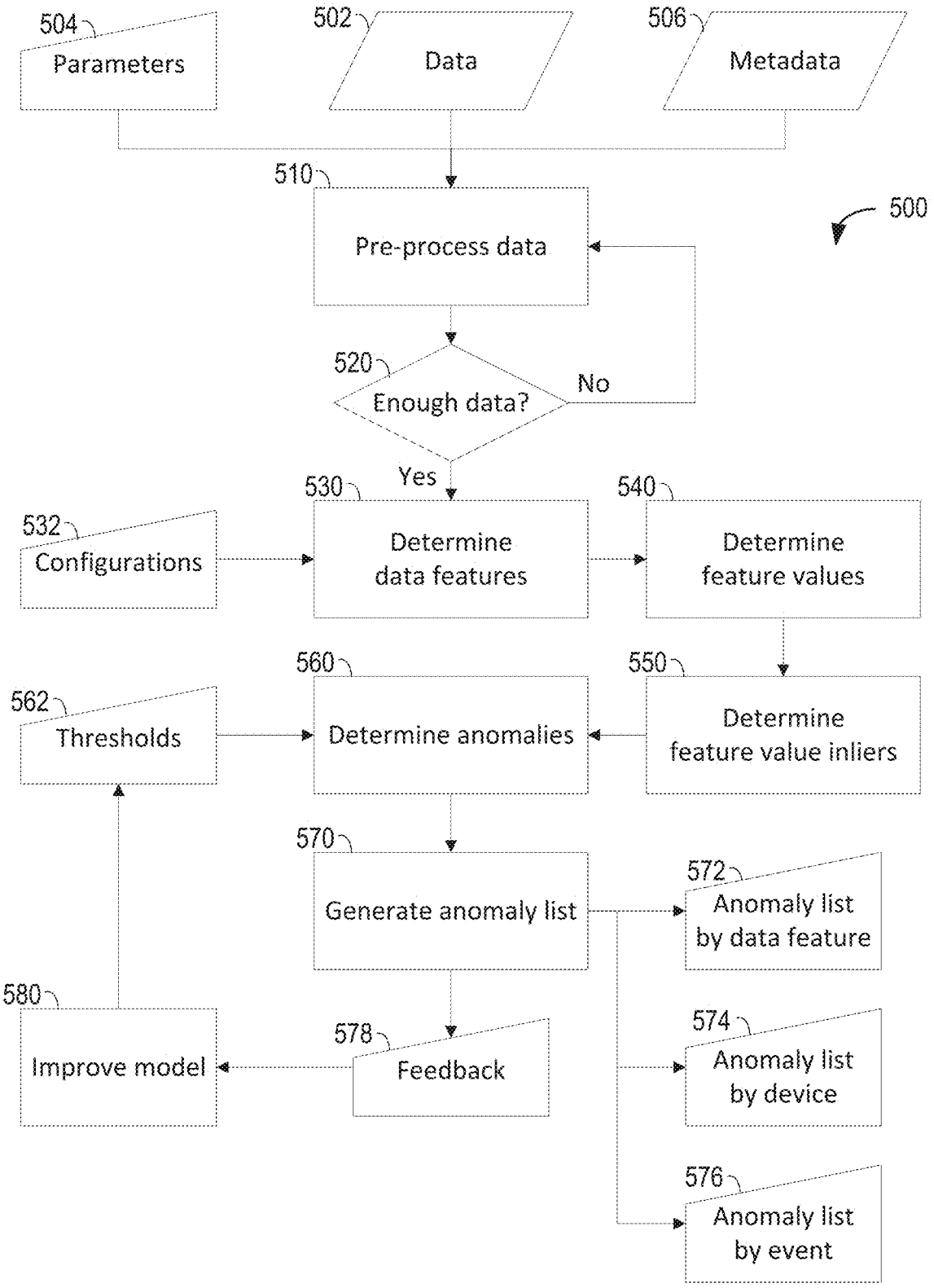
FIG. 7 is a flowchart illustrating another example method for detecting one or more anomalies amongst a plurality of peer devices in the environment of FIG. 4 and/or using the control system of FIG. 5.

FIG. 7 shows another example method 500 for detecting one or more anomalies amongst a plurality of peer devices (e.g., gearboxes 130, peer devices 210). As shown in FIG. 7, in addition to receiving data 502 (e.g., at operation 410), parameters 504 (e.g., at operation 420) and metadata 506 may also be received and/or determined. In some examples, the parameters 504 may be determined based on data 502, metadata 506, and/or other parameters 504 (e.g., duration of time, event, load, viscosity, etc.). The metadata 506 may include data that provides context or additional information about the data 502, such as a rig-move log, an operations log, date/time periods, and the like.

The data 502, parameters 504, and/or metadata 506 is queried, filtered, parsed, aggregated, formatted, and/or otherwise processed to generate pre-processed data at operation 510. It is determined at operation 520 whether a quantity of the data 502 satisfies a data threshold (e.g., if there is enough data). If the quantity of the data 502 does not satisfy or exceed the data threshold, then the method 500 waits until there is enough data to continue. When the quantity of the data 502 satisfies or exceeds the data threshold, the data is analyzed (e.g., at operation 440) to determine one or more data features at operation 530. In some examples, one or more configurations 532 are determined and used to facilitate determining the data features. Configurations may include, for example, application-specific waveform- and/or spectral-derived features. Example waveform-derived features include, without limitation, frequency, angular frequency, period, phase, wavelength, amplitude envelope, root mean square (RMS) amplitude, peak, amplitude, peak-to-peak amplitude, crest factor, kurtosis, skewness, etc. Example spectral-derived features include, without limitation, spectral frequency band received signal strength (RSS), peak, median, amplitude spectrum, power spectral density (PSD), phase spectrum, spectral bandwidth, spectral flatness, spectral skewness, spectral kurtosis, spectral entropy, spectral roll-off, spectral flux, frequency centroid, etc.

Each data feature is compared with each of the other data features (e.g., at operation 450) to determine a plurality of feature values at operation 540. In some examples, comparisons for each data feature are made for each event or date/time period such that the data features correspond to a common event or date/time period to ensure a relevancy of the relevant data features. For example, a data feature associated with a first gearbox 130 during a first event (e.g., moving the jack-up vessel 100 from the floating state to the docked state) may be compared with a data feature associated with each of the other peer devices during the first event. If another peer device is not associated with a data feature during the first event, a "NaN" or "Not a Number" value may be assigned.

The results from operation 540 may be appended as a multi-dimensional array and any duplicate rows may be deleted. For each combination row (e.g., of peer device/event), the feature values are analyzed to identify or determine one or more feature value inliers (e.g., inlying feature values) at operation 550 and one or more anomalies at operation 560. In some examples, one or more inlying feature values may be identified or determined based on a similarity in time, speed, load, pressure, force, temperature, flow, and/or other operating parameter, and one or more anomalies may be identified or determined based on a dissimilarity in time, speed, load, pressure, force, temperature, flow, and/or other operating parameter. For example, the feature values in a combination row may be analyzed to determine a mean and a standard deviation for the combination row, and the mean and standard deviation may be used to determine an anomaly score for each feature value in the combination row. In some examples, the anomaly score may be a number of standard deviations from the mean, and each feature value within the number of standard deviations from the mean may be determined to be an inlier, or not an anomaly. For example, each anomaly score may be compared with an anomaly threshold. If an anomaly score does not satisfy or exceed the anomaly threshold, the corresponding feature value may be determined to be an inlier. On the other hand, if the anomaly score satisfies or exceeds the anomaly threshold, the corresponding feature value may be determined to be an outlier or a candidate anomaly.

Alternatively, the anomaly score, inlying feature values, and/or outlying feature values may be calculated using any algorithm that enables the method 500 to function as described herein.

The results from operation 560 may be appended as a multi-dimensional array. In some examples, for each combination row, each delta time may be compared with a delta-time threshold. If the delta time satisfies or exceeds the delta-time threshold (e.g., indicating that the feature value or anomaly score was less relevant due to the time difference), a "NaN" value may be assigned to the corresponding feature value or anomaly score. Additionally, in some examples, a mean date/time may be calculated for each combination row, and individual delta times from the mean date/time may be calculated for each feature value or anomaly score. If a delta time satisfies or exceeds a delta-time threshold (e.g., indicating that the feature value or anomaly score was less relevant due to the time difference), a NaN value may be assigned to the corresponding feature value or anomaly score. In some examples, if a number of NaN values in a row satisfies or exceeds a NaN threshold (e.g., indicating that a peer-to-peer analysis may be less relevant due to the number of "NaN" values), the corresponding row may be deleted. In this manner, the nearest time occurrences may be considered, as well as the nearest speed, load, pressure, force, temperature, flow, and/or other operating parameter. In some examples, one or more thresholds 562 (e.g., anomaly threshold, delta-time threshold, "NaN" threshold) are used to facilitate determining the anomalies from the candidate anomalies.

Figure 8:
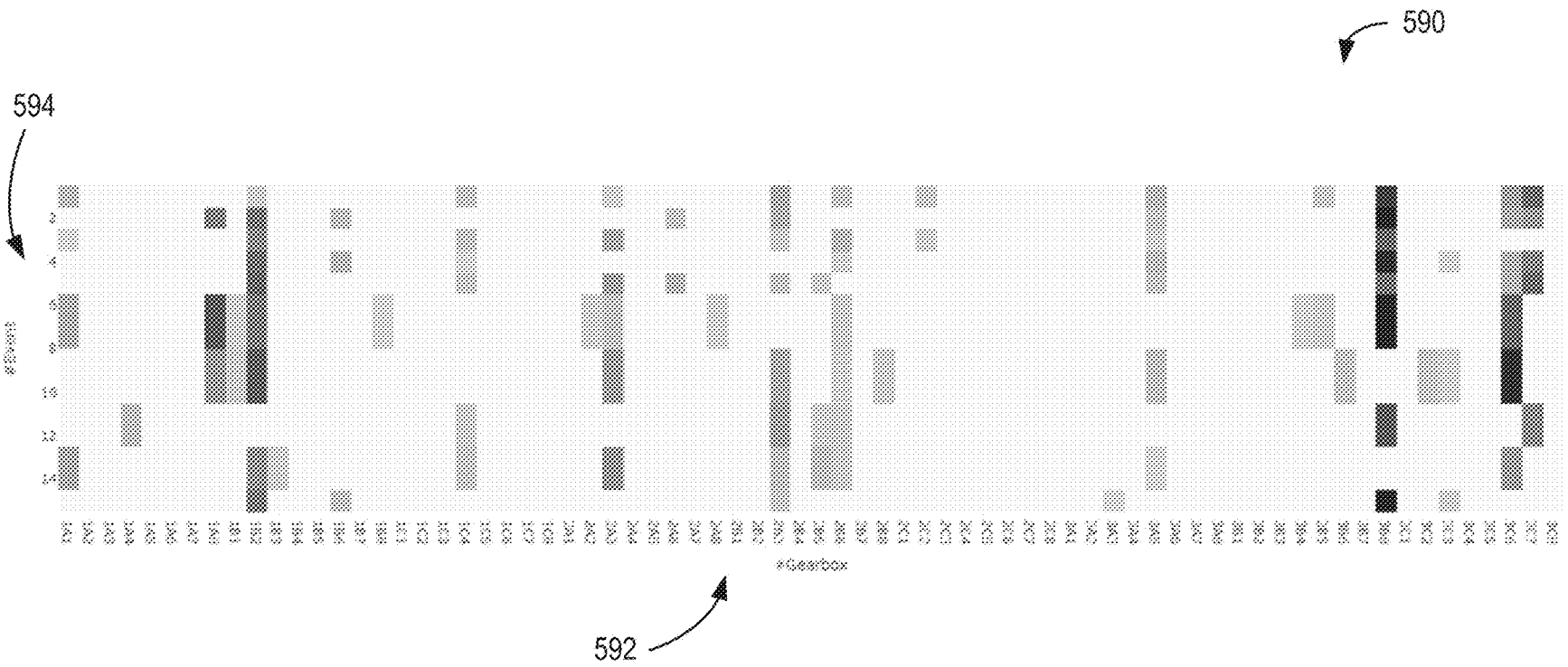
FIG. 8 is an example heatmap illustrating an example relationship between a plurality of peer devices and a plurality of events.

In some examples, the resultant multi-dimensional array may include measurement ID, values, event or date/time, delta-times, anomaly scores, anomaly status, having dimensional axis of features, assets, and combinations. From the resultant multi-dimensional array, one or more anomaly lists may be generated at operation 570, including an anomaly list by data feature 572 including a list of individual anomalies with feature values or anomaly scores, an anomaly list by device 574 including a list of peer devices with feature values or anomaly scores, and an anomaly list by event 576 including a list of peer devices aggregated by event with feature values or anomaly scores. Alternatively, the resultant multi-dimensional array may be used to generate any list, report, chart, or presentation that enables the method 500 to function as described herein. For example, FIG. 8 shows an example heatmap 590 that shows a relationship between gearboxes on the x-axis 592 and events on the y-axis 594. In the heatmap 590, the feature values or anomaly scores for each gearbox-event combination are depicted as colors. Moreover, referring back to FIG. 7, the resultant multi-dimensional array may be used as feedback 578 for use in improving a machine learning model at operation 580. The feedback 578 may be used, for example, to select, create, and/or transform at least one threshold 562 to facilitate improving the method 500.

Figure 9:
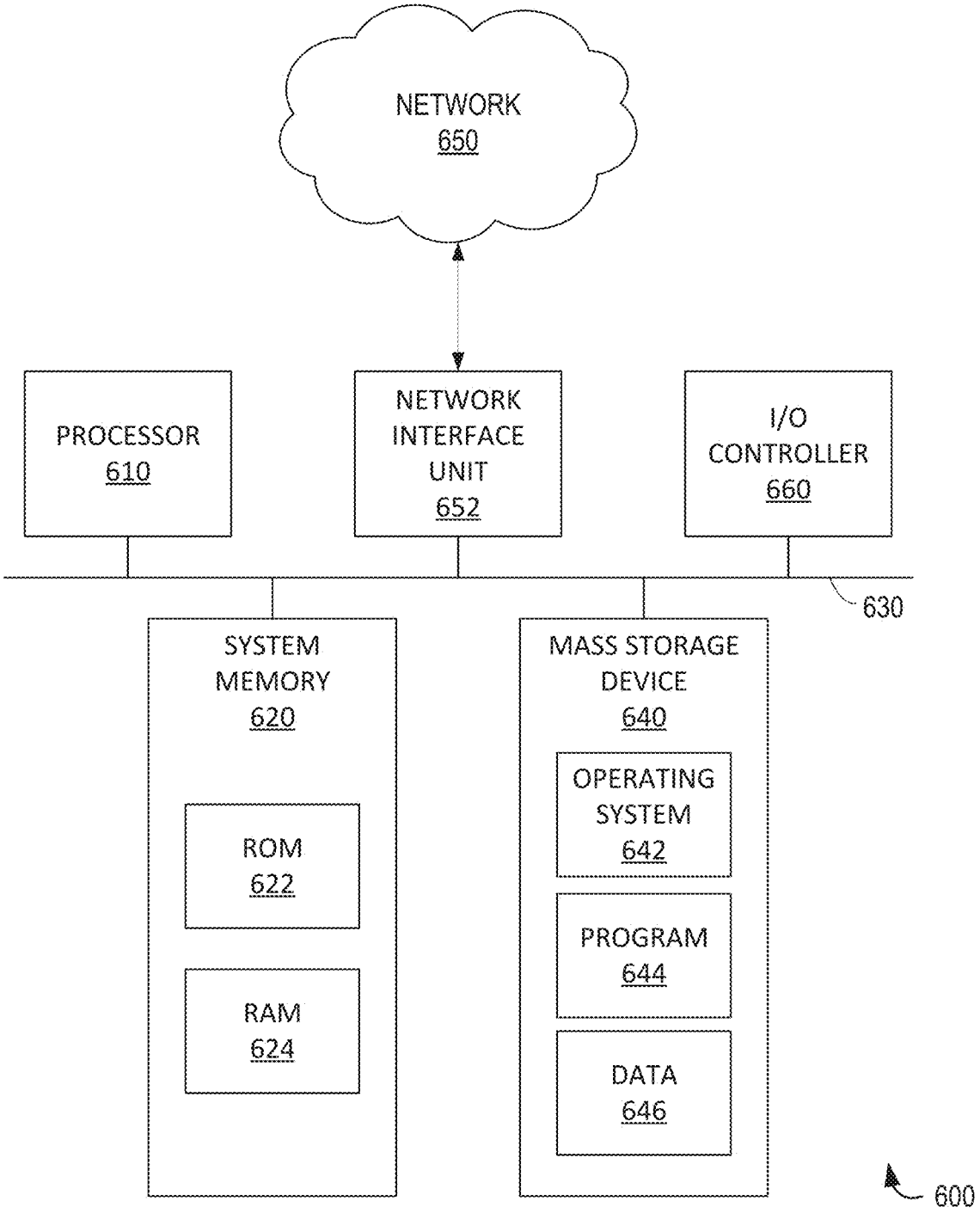
FIG. 9 is a computer architecture diagram illustrating an computing system that may be used to perform one or more computing operations in the environment of FIG. 4 and/or control system of FIG. 5.

FIG. 9 shows an example computing system 600 (e.g., monitoring system 140, monitoring system 220, control system 300, server 310, user computer 320) configured to perform one or more computing operations described herein. In some examples, the computing system 600 includes a processor 610, a system memory 620, and a bus 630 coupling various system components including the system memory 620 to the processor 610.

The processor 610 is configured to perform computing functions and process data and instructions to perform one or more operations and/or provide other functionality described herein. For example, the processor 610 may access the system memory 620 to read data and instructions from and/or write data and instructions to the system memory 620 for use in executing one or more computer-executable instructions. In this manner, the processor 610 may be programmed to execute any aspect of the software components described herein, including software components for implementing the application 322 (shown in FIG. 5) and/or API 326 (shown in FIG. 5). In some examples, the processor 610 may be or include any quantity of processing units including a central processing unit, a graphics processing unit, a field-programmable gate array (FPGA), a digital signal processor (DSP), or other hardware logic components including, without limitation, an Application-Specific Integrated Circuit (ASIC), Application-Specific Standard Product (ASSP), System-on-a-Chip System (SOC), Complex Programmable Logic Device (CPLD), etc.

The system memory 620 includes any combination of computer-readable media that may be accessed by the processor 610. In some examples, the system memory 620 includes a read-only memory (ROM) 632 which stores instructions for executing basic functions and a random access memory (RAM) 634 which temporarily stores data and instructions for actively used programs. For example, the RAM 634 may be used to host or store data 502, parameters 504, metadata 506, configurations 532, thresholds 562, and/or feedback 578, as well as one or more software components for implementing the application 322 (shown in FIG. 5) and/or API 326 (shown in FIG. 5).

Computer-readable media includes both communication media and computer storage media. Communication media typically embody computer-readable instructions, data structures, program modules, or other data in a modulated data signal, such as a carrier wave or other transport mechanism. The term "modulated data signal" means a signal that has one or more of its characteristics set or changed in a manner as to encode information in the signal. By way of example, and not limitation, communication media includes wired media, such as a wired network or direct-wired connection, and wireless media, such as acoustic, radio frequency, and infrared media.

In contrast, computer storage media include non-transitory, tangible forms of media that can store information such as computer-readable instructions, data structures, program modules, or other data. By way of example, and not limitation, computer storage media includes ROM 632, RAM 634, hard disk drives (HDDs), solid-state drives (SSDs), external hard drives, flash drives, optical storage media (e.g., compact discs (CDs), digital versatile discs (DVDs), and magnetic storage media (e.g., tape drives). For purposes of the present disclosure, computer storage media is mutually exclusive to communication media and excludes waves, signals, and other transitory or intangible forms of media.

It should be appreciated that the software components described herein, when loaded into the processor 610 and executed, may transform the processor 610 and the overall computing system 600 from a general-purpose computing system into a special-purpose computing system (e.g., a rotational equipment peer anomaly system, a rotational equipment peer anomaly processor) customized to facilitate the functionality described herein. More specifically, the computer-executable instructions contained within the software components described herein (e.g., rotational equipment peer anomaly processor executable instructions) transform the processor 610 to operate or function as a finite-state machine by specifying how the processor 610 transitions between states, thereby transforming the transistors or other discrete circuit elements constituting the processor 610.

Encoding the software components described herein may also transform the physical structure of the computer-readable media described herein. The specific transformation of physical structure may depend on various factors, in different implementations of the present disclosure. Examples of such factors may include, but are not limited to, the technology used to implement the computer-readable media, whether the computer-readable media is characterized as primary or secondary storage, and the like. For example, if the computer-readable media is implemented as semiconductor-based memory, the software disclosed herein may be encoded on the computer-readable media by transforming the physical state of the transistors, capacitors, or other discrete circuit elements constituting the semiconductor-based memory. The software also may transform the physical state of such components in order to store data thereupon.

As another example, the computer-readable media disclosed herein may be implemented using magnetic or optical technology. In such implementations, the software presented herein may transform the physical state of magnetic or optical media, when the software is encoded therein. These transformations may include altering the magnetic characteristics of particular locations within given magnetic media. These transformations also may include altering the physical features or characteristics of particular locations within given optical media, to change the optical characteristics of those locations. Other transformations of physical media are possible without departing from the scope and spirit of the present description, with the foregoing examples provided only to facilitate this discussion.

In some examples, the computing system 600 includes a mass storage device 640 (e.g., data warehouse 340) coupled to the processor 610 for hosting or storing data and instructions, such as an operating system 642, one or more programs 644 (e.g., application 322, API 326), and/or data 646 (e.g., data 502, parameters 504, metadata 506, configurations 532, thresholds 562, and/or feedback 578). One of ordinary skill in the art would understand that copies of at least some data and/or instructions hosted or stored in the mass storage device 640 may be at least temporarily stored in the system memory 620 to enable the computing system 600 to function as described herein.

As shown in FIG. 6, the computing system 600 may connect to a network 650 through a network interface unit 652 connected to the bus 630. In this manner, the computing system 600 may operate in a networked environment in which the computing system 600 may use one or more remote devices (not shown) to host or store at least some data and/or to execute at least some instructions. The network 650 may include one or more wired and/or wireless connections. Computer communication between computing systems can be a network transfer, a file transfer, an applet transfer, an email, a hypertext transfer protocol (HTTP) transfer, and so on.

In some examples, the computing system 600 may include one or more input/output (I/O) controllers 660 that facilitate communication and data transfer between the processor 610 and one or more I/O devices (not shown) configured to provide input and/or output capabilities. For example, a user (e.g., user 324) may enter commands and information into the computing system 600 using one or more input devices, such as a keyboard, pointing device (e.g., mouse, trackball, touch pad, stylus), microphone, camera, scanner, accelerometer, and the like. Additionally, or alternatively, the computing system 600 may present various forms of information, such as text, images, audio, video, alerts, and the like, using one or more output devices, such as a monitor, projector, printer, speaker, actuator, and the like. In some examples, the output device may be integrated with the input device (e.g., in a touchscreen panel or in a controller including a vibrating component).

While some examples are illustrated and described herein with reference to the computing system 600 being, including, or being included in the monitoring system 140 (shown in FIGS. 1-3), monitoring system 220 (shown in FIG. 4), control system 300 (shown in FIG. 5), server 310 (shown in FIG. 5), and/or user computer 320 (shown in FIG. 5), aspects of the present disclosure are operable with any computing system that can execute computer-executable instructions to implement the operations and functionality associated with the computing system 600. It is also contemplated that the computing system 600 may not include all of the components shown in FIG. 6, may include other components that are not explicitly shown in FIG. 6, or may utilize an architecture completely different than that shown in FIG. 6. The computing system 600 should not be interpreted as having any dependency or requirement relating to any one or combination of components shown in FIG. 6. The computing system 600 is only one example of a computing and networking environment for performing one or more computing operations and is not intended to suggest any limitation as to the scope of use or functionality of the present disclosure.

Example methods and systems are described herein for detecting one or more anomalies amongst a plurality of peer devices. The examples described herein provide useful information in real-time (or near real-time) to facilitate managing and/or operating a plurality of peer devices in an efficient and reliable manner. For example, an application or API may be used to monitor a current operation and/or status of a plurality of peer devices and detecting one or more anomalies amongst the peer devices. In view of the above, it will be seen that several advantages of the aspects of the present disclosure are achieved and other advantageous results attained.

Although described in connection with an example computing system environment, examples of the present disclosure are capable of implementation with numerous other general purpose or special purpose computing system environments, configurations, or devices. Examples of well-known computing systems, environments, and/or configurations that may be suitable for use with aspects of the disclosure include, but are not limited to, server computers, desktop computers, laptop computers, tablets, mobile devices, communication devices in wearable or accessory form factors, microprocessor-based systems, multiprocessor systems, programmable consumer electronics, kiosks, tabletop devices, industrial control devices, minicomputers, mainframe computers, network computers, distributed computing environments that include any of the above systems or devices, and the like.

Examples of the present disclosure may be described in the general context of computer-executable instructions, such as program modules, executed by one or more computers or other devices in software, firmware, hardware, or a combination thereof. The computer-executable instructions may be organized into one or more computer-executable modules or components. Generally, program modules include, but are not limited to, routines, objects, components, and data structures that perform particular tasks or implement particular abstract data types. Aspects of the disclosure may be implemented with any number and organization of such modules or components. For example, aspects of the present disclosure are not limited to the specific computer-executable instructions or the specific components or modules illustrated in the figures and described herein. Other examples of the present disclosure may include different computer-executable instructions or components having more or less functionality than illustrated and described herein.

In some examples, the operations illustrated in the drawings may be implemented as software instructions encoded on a computer readable medium, in hardware programmed or designed to perform the operations, or both. For example, aspects of the present disclosure may be implemented as a system on a chip or other circuitry including a plurality of interconnected, electrically conductive elements.

It is possible for one or more elements of an implementation of an apparatus as described herein to be used to perform tasks or execute other sets of instructions that are not directly related to an operation of the apparatus, such as a task relating to another operation of a device or system in which the apparatus is embedded. It is also possible for one or more elements of an implementation of such an apparatus to have structure in common (e.g., a processor used to execute portions of code corresponding to different elements at different times, a set of instructions executed to perform tasks corresponding to different elements at different times, or an arrangement of electronic and/or optical devices performing operations for different elements at different times).

The order of execution or performance of the operations in examples of the present disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the present disclosure.

The examples illustrated and described herein as well as examples not specifically described herein but within the scope of aspects of the present disclosure constitute example means for detecting one or more anomalies amongst a plurality of peer devices. For example, the elements illustrated in FIGS. 1, 4, 5, and 9, when programmed, encoded, or configured to perform the operations illustrated in FIGS. 7 and 8, constitute at least an example means for receiving data associated with a plurality of peer devices (e.g., monitoring system 140, monitoring system 220, control system 300, server 310, user computer 320), an example means for analyzing data to determine a plurality of data features associated with a plurality of peer devices (e.g., monitoring system 140, monitoring system 220, control system 300, server 310, user computer 320), an example means for comparing each data feature with each of the other data features to determine a plurality of feature values associated with a plurality of peer devices (e.g., monitoring system 140, monitoring system 220, control system 300, server 310, user computer 320), and an example means for analyzing a plurality of feature values to identify, from the plurality of feature values, at least a first feature value satisfying an anomaly threshold devices (e.g., monitoring system 140, monitoring system 220, control system 300, server 310, user computer 320).

When introducing elements of aspects of the disclosure or the examples thereof, the articles "a," "an," "the," and "said" are intended to mean that there are one or more of the elements. Furthermore, references to an "embodiment" or "example" of the present disclosure are not intended to be interpreted as excluding the existence of additional embodiments or examples that also incorporate the recited features. The terms "comprising," "including," and "having" are intended to be inclusive and mean that there may be additional elements other than the listed elements. The phrase "one or more of the following: A, B, and C" means "at least one of A and/or at least one of B and/or at least one of C."

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

In the present description, reference numbers have sometimes been used in connection with various terms. Where a term is used in connection with a reference number, this may be meant to refer to a specific element that is shown in one or more of the figures. Where a term is used without a reference number, this may be meant to refer generally to the term without limitation to any particular figure.

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

While the aspects of the present disclosure have been described in terms of various examples with their associated operations, a person skilled in the art would appreciate that a combination of operations from any number of different examples is also within the scope of the aspects of the present disclosure.

What is claimed is:

1. A rotational equipment peer anomaly system for a plurality of rotational equipment peer devices, the rotational equipment peer anomaly system comprising:

a plurality of rotational equipment condition sensors configured to detect one or more rotational equipment conditions associated with the plurality of rotational equipment peer devices and generate rotational equipment condition sensor data corresponding to the one or more rotational equipment conditions;

one or more actuators associated with the plurality of rotational equipment peer devices;

a rotational equipment peer anomaly processor; and a non-transitory tangible storage medium storing rotational equipment peer anomaly processor executable instructions that, when executed by the rotational equipment peer anomaly processor, causes the rotational equipment peer anomaly processor to:

receive, during an event, the rotational equipment condition sensor data;

determine at least one data scope parameter;

apply the at least one data scope parameter to the rotational equipment condition sensor data;

analyze the rotational equipment condition sensor data to determine a plurality of rotational equipment condition data features associated with the plurality of rotational equipment peer devices, wherein the plurality of rotational equipment condition data features comprises at least one of waveform features or spectral-derived features;

compare each rotational equipment condition data feature with each of the other rotational equipment condition data features to determine a plurality of rotational equipment condition data feature values associated with the plurality of rotational equipment peer devices;

analyze the plurality of rotational equipment condition data feature values to identify, from the plurality of rotational equipment condition data feature values, at least a first rotational equipment condition data feature value satisfying an anomaly threshold, wherein the first rotational equipment condition data feature value corresponds to a first rotational equipment peer device of the plurality of rotational equipment peer devices; and automatically operate the one or more actuators to modify an operation of the first rotational equipment peer device based on the first rotational equipment condition data feature value satisfying the anomaly threshold.

2. The system of claim 1, wherein the non-transitory tangible storage medium stores further rotational equipment peer anomaly processor executable instructions that, when executed by the rotational equipment peer anomaly processor, causes the rotational equipment peer anomaly processor to:

determine whether a quantity of the rotational equipment condition sensor data satisfies a data threshold; and analyze the rotational equipment condition sensor data to determine the plurality of rotational equipment condition data features associated with the plurality of rotational equipment peer devices on condition that the quantity of the rotational equipment condition sensor data satisfies the data threshold.

3. The system of claim 1, wherein the non-transitory tangible storage medium stores further rotational equipment peer anomaly processor executable instructions that, when executed by the rotational equipment peer anomaly processor, causes the rotational equipment peer anomaly processor to:

identify one or more configurations; and determine the plurality of rotational equipment condition data features based on the one or more configurations.

4. The system of claim 1, wherein the non-transitory tangible storage medium stores further rotational equipment peer anomaly processor executable instructions that, when executed by the rotational equipment peer anomaly processor, causes the rotational equipment peer anomaly processor to:

identify a period of time or event; and compare the rotational equipment condition data features corresponding to the period of time or event.

5. The system of claim 1, wherein the non-transitory tangible storage medium stores further rotational equipment peer anomaly processor executable instructions that, when executed by the rotational equipment peer anomaly processor, causes the rotational equipment peer anomaly processor to:

analyze the plurality of rotational equipment condition data feature values to identify, from the plurality of rotational equipment condition data feature values, one or more rotational equipment condition data feature values corresponding to one or more candidate anomalies; and compare the one or more rotational equipment condition data feature values corresponding to the one or more candidate anomalies to the anomaly threshold to identify, from the one or more rotational equipment condition data feature values corresponding to the one or more candidate anomalies, the at least the first rotational equipment condition data feature value satisfying the anomaly threshold.

6. The system of claim 1, wherein the non-transitory tangible storage medium stores further rotational equipment peer anomaly processor executable instructions that, when executed by the rotational equipment peer anomaly processor, causes the rotational equipment peer anomaly processor to:

determine, from the plurality of rotational equipment condition data feature values, one or more inlying feature values and one or more outlying feature values; and compare the one or more outlying feature values to the anomaly threshold to identify the at least the first rotational equipment condition data feature value satisfying the anomaly threshold.

7. The system of claim 1, wherein the non-transitory tangible storage medium stores further rotational equipment peer anomaly processor executable instructions that, when executed by the rotational equipment peer anomaly processor, causes the rotational equipment peer anomaly processor to generate a list including the at least the first rotational equipment condition data feature value satisfying the anomaly threshold.

8. The system of claim 1, wherein the non-transitory tangible storage medium stores further rotational equipment peer anomaly processor executable instructions that, when executed by the rotational equipment peer anomaly processor, causes the rotational equipment peer anomaly processor to use the at least the first rotational equipment condition data feature value to determine a new anomaly threshold.

9. The system of claim 1, further comprising one or more actuators, wherein the non-transitory tangible storage medium stores further rotational equipment peer anomaly processor executable instructions that, when executed by the rotational equipment peer anomaly processor, causes the rotational equipment peer anomaly processor to automatically operate the one or more actuators to inspect the first rotational equipment peer device.

10. The system of claim 1, wherein the operation of the first rotational equipment peer comprises at least one of moving one or more objects, dispensing lubricant, providing control panel warnings, or providing integrated operations on graphical user interfaces (GUIs).

11. The system of claim 1, wherein the plurality of rotational equipment peer devices comprises at least one of a jacking gearbox, a propulsion gearbox, a power generation gearbox, a rotary table gearbox, a crane gearbox, or a winch gearbox.

12. The system of claim 1, wherein the non-transitory tangible storage medium stores further rotational equipment peer anomaly processor executable instructions that, when executed by the rotational equipment peer anomaly processor, causes the rotational equipment peer anomaly processor to:

provide, in real-time at least one of the plurality of rotational equipment condition data features or the first rotational equipment condition data feature value satisfying an anomaly threshold to at least one of an application or an application programming interface (API).

* * * * *